US005277475A

United States Patent [19]

Brandes

[11] Patent Number: 5,277,475

[45] Date of Patent: Jan. 11, 1994

[54] ONE PIECE BACK SUPPORT FOR A CHAIR

[75] Inventor: Timothy R. Brandes, Lakeville, Minn.

[73] Assignee: Engineered Components, Inc., Lakeville, Minn.

[21] Appl. No.: 914,430

[22] Filed: Jul. 15, 1992

[51] Int. Cl.[5] ..... B60N 2/02

[52] U.S. Cl. ..... 297/354.11; 297/220

[58] Field of Search ..... 297/354, 355, 374, 291, 297/292, 408, 220, 391

[56] References Cited

U.S. PATENT DOCUMENTS

| | | | |
|---|---|---|---|
| 2,114,920 | 4/1938 | Grabb | 297/354 |
| 4,007,962 | 2/1977 | Müller-Deisig | 297/355 |
| 4,135,836 | 1/1979 | Rensland | 297/291 |
| 4,316,632 | 2/1982 | Bräuning | 297/291 |

FOREIGN PATENT DOCUMENTS

| | | | |
|---|---|---|---|
| 532625 | 11/1956 | Canada | 297/374 |
| 1654375 | 2/1971 | Fed. Rep. of Germany | 297/291 |
| 476944 | 12/1937 | United Kingdom | 297/355 |
| 2087719 | 6/1982 | United Kingdom | 297/354 |

*Primary Examiner*—Peter M. Cuomo
*Assistant Examiner*—Flemming Saether
*Attorney, Agent, or Firm*—Lawrence M. Nawrocki

[57] ABSTRACT

A one-piece back support for a chair. The support includes a substantially integral backing member having a front side, a back side, and top and bottom edges. The backing member defines, on its front side, a substantially vertical, concave channel. The channel communicates with the bottom edge of the backing member and terminates proximate the center of the backing member. The channel is sized and shaped to receive a "T"-shaped support member so that the backing member is supported by the support member. The backing member, in view of the manner of mounting, can be pivoted about the support member, the channel including laterally extending notches. Such notches project from the main channel portion at its end generally centrally located within the backing member. The "T" portion of the support member is, thereby, received within the channel and notches. The support also includes means to limit the extent to which the backing member can be pivoted with respect to the support member.

9 Claims, 5 Drawing Sheets

ONE PIECE BACK SUPPORT FOR A CHAIR

BACKGROUND OF THE INVENTION

This invention relates to back rests or back supports for a chair. More particularly, this invention relates to one-piece back supports for a chair, such as an office chair. Yet more particularly, this invention relates to one-piece back supports or back rests for a chair having a unique configuration and arrangement of component parts which make it economical to manufacture, and which provide enhanced safety in use and mitigation of failure modes when a chair using the invention is abused or is occupied by larger person.

Conventional chair back rests comprise, from back to front, a vertical support which is attached in some fashion to, the back side of a backing member. The backing member then has located on its remaining front side, a pad. The vertical support holds the backing member in place and supports the back or dorsal side of an occupant of the chair. The pad, placed between the backing member and an occupant of the chair, provides comfort and support to the chair's user.

Conventional chair back rests as described above have shown a particularly unfortunate failure mode, especially when used by larger persons. When a large or heavy person leans backward in a conventional chair, substantial force is exerted against the back support. The backward force, generally being exerted against the top and upper portion of the back support, tends to bend or leverage the upper portion of the back support against the verticle support member. Because there is no restraining force applied against the lower portion or base of the back rest, the back rest is inherently leveraged, bent, or pivots against its verticle support at its structurally weakest point. Conventional back supports, generally being supported in their middle on their back side (i.e., the side away from the chair user) tend to break in what has been referred to as a "half moon" failure mode in response to this force. The "half moon" refers to the shape of a crack or break in the backing member. Such a failure mode, if sudden and complete, potentially permits the vertical support member to pass through the backing member and possibly injure the user.

The present invention mitigates one of the possible failure modes of conventional chair back supports in utilizing a unique arrangement of vertical support and backing member. The aforementioned "half-moon" failure mode is mitigated because the structurally strongest portion of the present invention is located where this failure mode is likely to occur. In addition, the present invention, in a preferred embodiment, permits the utilization of relatively inexpensive, composite materials.

BRIEF DESCRIPTION OF THE INVENTION

Briefly, in one aspect, the present invention comprises a one-piece back support for a chair. The back support comprises a substantially integral backing member, the backing member having a front side or face, a back side or face, top and bottom edges. The front side of the backing member, as used in this invention, is the side closest to a chair's occupant.

In the front side of the backing member is a concave channel. The concave channel connects or communicates with the bottom edge of the backing member and terminates at substantially the middle or center of the front side of the backing member. The aforementioned channel in the front face or side of the backing member is shaped to receive a "T" shaped, vertical support member. In a preferred practice, the vertical support member is forwardly offset. Such a preferred vertical support member would comprise a substantially elongated primary section which merges into an angularly offset shorter section and which terminates with a substantially horizontal or perpendicular bar or "T" top. The angularly offset section of the vertical support member, when utilized to support the backing member, is therefor, angularly offset toward the back or dorsal side of the chairs' occupant. The aforementioned channel, then, is adapted to receive the T-shaped vertical support member so that backing member can pivot, back-to-front thereabout. This is accomplished by means of cooperation between the channel containing the vertical segment of the support member and substantially horizontal notches projecting from the terminus of the channel to receive the "T" top portion of the support member.

Completing the backing member, in its preferred practice, are means to retain the "T" portion of a vertical support member within the horizontally-directed notches and means to limit the extent to which the backing member may be pivoted with respect to the vertical support member. The previously mentioned retention means, in a preferred practice, is a plate anchored or attached to the front face of the backing member. The aforementioned limiting means, in the preferred embodiment, is a flat bracket which crosses the aforementioned channel adjacent the bottom edge of the backing member. In a preferred practice, the limiting means also provides an edge or ledge into which covering fabric may be stapled. In a further preferred practice, a back support of this invention includes the above-described T-shaped, (preferably offset), vertical support member. Generally speaking, the vertical support member is itself, adapted to cooperate with the remainder of any conventional chair structure e.g., on its vertical segment projecting automatically from the backing member.

In a preferred practice, the present backing member comprises a composite material such as compression molded particle board. Preferably a backing member made from such composite material will have a thickness of at least ¾ inch. Composite materials such as particle board are generally less expensive than plastics presently used. The present invention thus permits utilization of less expensive material in a safe and efficient, easily manufactured, manner e.g., by molding.

The term "one-piece" is used extensively to describe the present invention. "One-piece" as used herein means a single, integral backing member. More specifically the term "one-piece" is intended to exclude two piece chair backing members comprising front and back pieces having a vertical support, of some sort, sandwiched or contained therebetween. The one-piece construction of the present invention achieves substantial cost savings and increased efficiency of production. Moreover, utilization of the present invention produces a one-piece chair construction which is more attractive than conventional one-piece back rests because no connector hardware is visible. The more expensive two-piece construction is sometimes used for exactly this purpose viz., to conceal back upright hardware.

BRIEF DESCRIPTION OF THE DRAWINGS

The present invention may be better understood with reference to the Detailed Description below and to the attached drawings in which like numerals are used to refer to like features and in which.

DETAILED DESCRIPTION OF THE INVENTION

Figure 1:
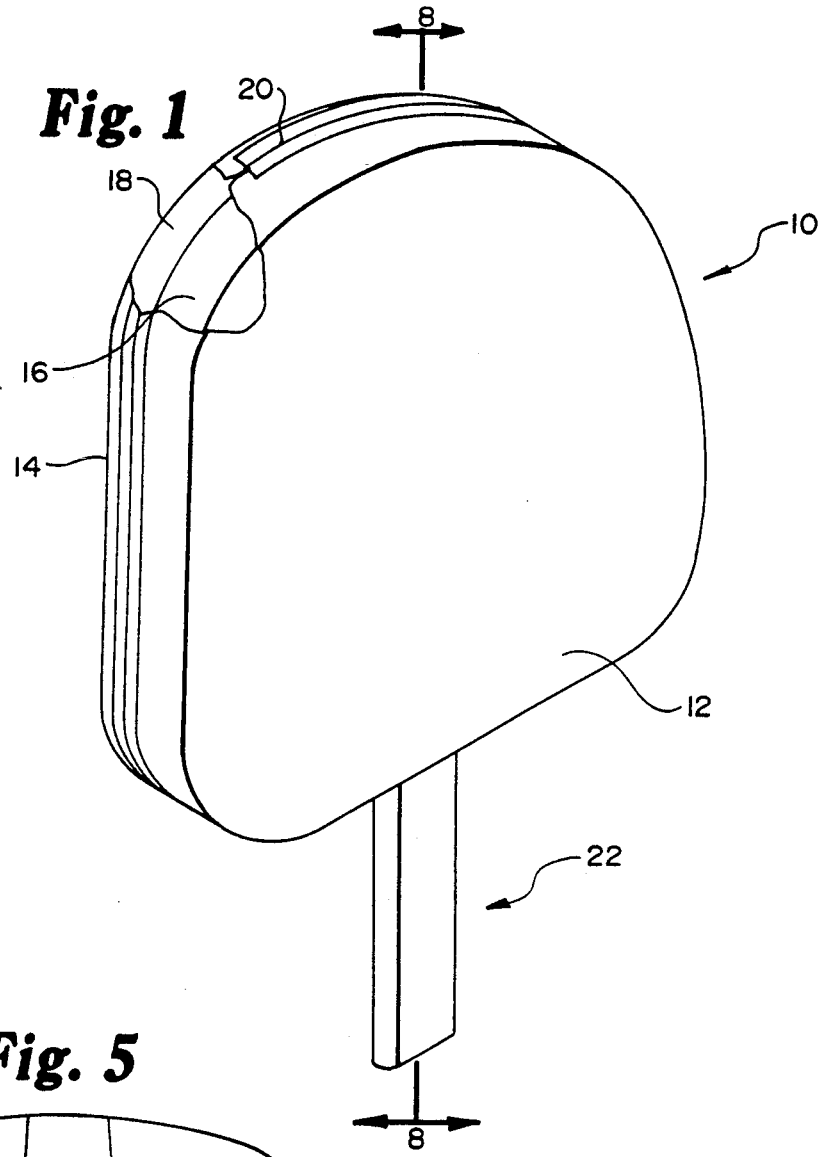
FIG. 1 is a perspective view of a back support of the present invention a vertical support.

Thus there it is shown in FIG. 1 a back support for a chair 10. Chair back 10, which interiorly includes a backing member of this invention, has a front cloth 12, and a rear cloth 14. Beneath front cloth 12, in partial cut away view, in the upper left of FIG. 1 is cushion or front pad 16. For most back supports, pads generally comprise a sheet or piece of polymeric or foam material or a cushion. Front cloth 12 holds pad 16 in place against a backing member 18 of this invention, a portion of which is also shown in the cut away view. Front cloth 12 holds pad 16 and supports and covers it to provide a comfortable, conformable surface on which the occupant of a chair using this invention can sit. Front cloth 12 and rear cloth 14 are affixed, e.g., by stapling, to the edge of backing member 18 and their edges are covered by trim 20. This embodiment of the invention includes the lower portion of vertical support member 22 shown projecting from the bottom edge of chair back 10. It is to be understood that chair back 10 can, by modification of vertical support member 22, be adapted for use with substantially any articulated back chair. One skilled in this art will appreciate that the present invention would generally be a part of a chair in the middle price segment of the chair market. Such chairs are sometimes referred to as a "task" or secretarial chairs.

Figure 2:
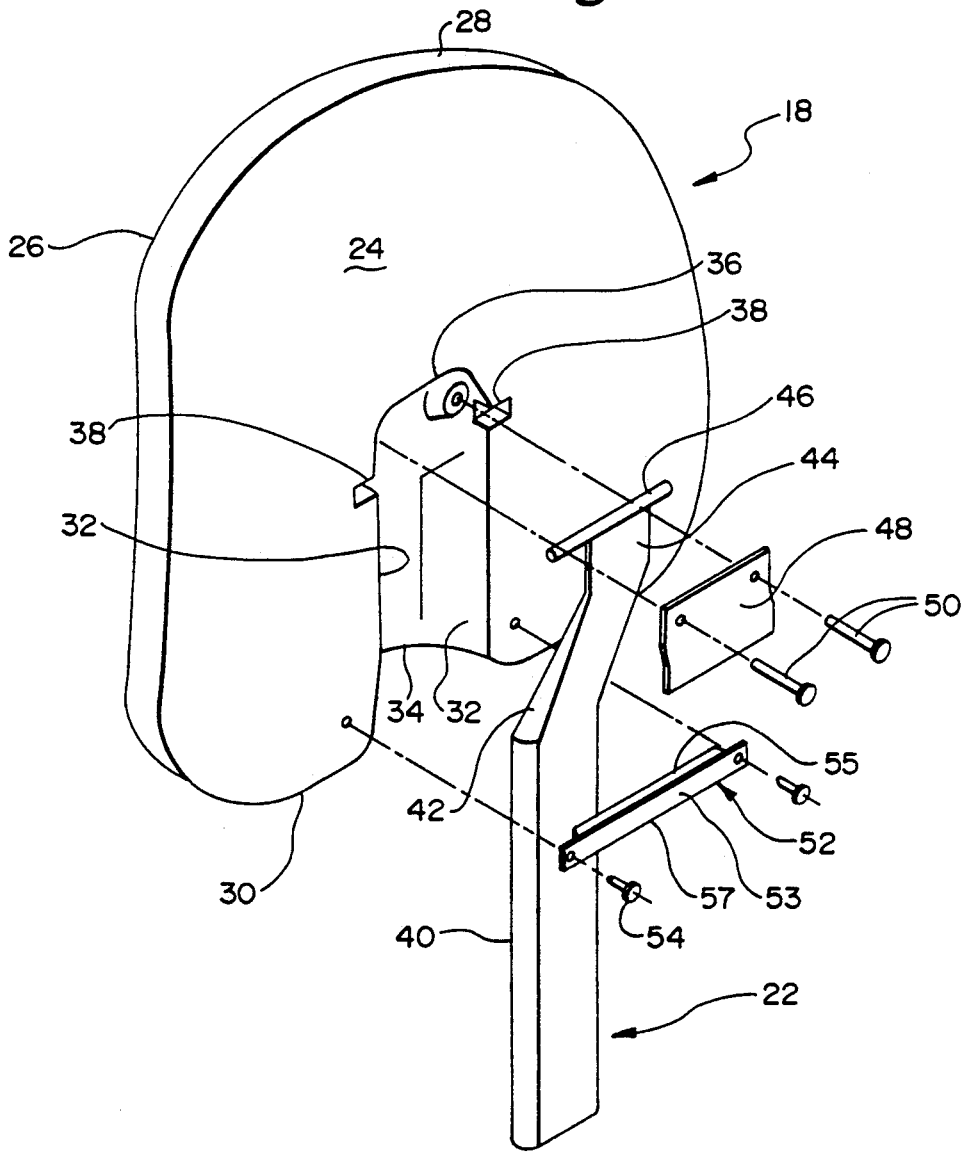
FIG. 2 an exploded view of a backing member of the present invention shown in FIG. 1 with pad removed.

FIG. 2 shows the details of one embodiment of a backing member 18 of the present invention. Backing member 18 comprises a front side or face 24, a back side or face 26, top and bottom edges, 28, 30, respectively. Located in front side and thereby defined is an elongate, usually vertical, channel 32. Channel 32 communicates with or intersects bottom edge 30, defining a rounded "U"-shaped opening 34 at that intersection. Channel 32 is of generally a rounded "U" shape in section. Channel 32 extends from opening 34 to approximately the middle or center of backing member 18 where it merges with front face 24, defining an arcuate opening 36. Projecting laterally or horizontally from channel 32 are notches 38. Notches 38, in this embodiment, are located near the terminus 36 of channel 32 at approximately the center of backing member 18. Channel 32 is shaped to receive a "T"-shaped, preferably forwardly offset, vertical support member 22. While the cross sectional configuration of support member 22 is not critical, in this embodiment, it is of a flattened tubular arrangement. Support member 22 comprises a substantially straight segment 40, which merges into a forwardly or angularly offset (with respect to verticle) intermediate segment 42. Intermediate segment 42 merges or continues to a second substantially straight segment 44 which ends with a horizontally disposed rod 46. Segments 40, 42, 44 and rod 46 define what is referred to herein as the "T" shaped, offset, vertical support member. One skilled in this art will appreciate that other support member configurations, which accomplish the advantages of this invention, may be employed.

Channel 32 and vertical support member 22 are adapted to each other to permit backing member 18 to pivot, back-to-front, with respect to the support member. (This is more clearly illustrated in FIG. 8.) Backing member 18 can pivot with respect to vertical support member 22 because member 22 is retained within channel 32 by retainer means or plate 48. Retainer means 48 comprises a plate which is anchored to the front face or side 24 of backing member 18 by a plurality of screws 50 and backside nuts (not shown in FIG. 2). Cooperation between notches 38 and the rod or top portion of the "T"-shaped vertical support permit the entire backing member to be supported and to pivot thereby. The range of pivot between backing member 18 and vertical support member 22 is restricted by limit means 52. In the embodiment shown, limit means 52 is a flat metal bar 53 which is held against face 24 by a second plurality of screws 54 which, in turn, screw into backing member 18. Limit means 52 overlies channel 32 at approximately the bottom edge 30 of backing member 18, thusly defining a "D" shaped, downward projecting opening. The range of pivot between backing member 18 and vertical support member 22 can be increased if, for example, a hat bracket rather than a flat plate were used to overlie channel 32.

Limit means 52 comprises a flat plate 53 and an interior staple ledge 55. Staple ledge 55 is affixed to plate 53 by adhesive or other means. Staple ledge 55 is comprised of a material, e.g., wood, which is soft enough to be penetrated by fabric staples to hold trim thereon. Staple ledge 55 is located on plate 53 so as to permit staples to be inserted edgewise. This means that the downward edge of staple ledge 55 is generally flush with or projecting below the downward edge 57 of plate 53.

It is the above-described arrangement of support and backing member which provides one of the primary advantages of the present invention, i.e., mitigation of possible injury were the support structure to fail. By virtue of the fact that the vertical support member is located between the user of the chair and the primary support-giving backing member, the "half moon" failure mode discussed above is substantially reduced or eliminated. The strain applied to the backing member, when under heavy use or even abuse, would, at most cause the vertical support member to be pulled from its anchor points. Put otherwise, by virtue of the present configuration, the most likely location of a failure, is directed to the structure location which is the strongest, i.e., the center of the backing member.

As noted above, in a preferred practice of this invention, backing member 18 comprises a molded, composite, material which is relatively thick. By this it is meant, for example, that backing member is at least about ¾ inches in thickness. A preferred composite material is molded particle board. With a thickness in the preferred range, the likelihood of failure is substantially reduced or eliminated. Moreover, the structural arrangement permits the utilization of many other relatively inexpensive molded, composite materials.

Figure 3:
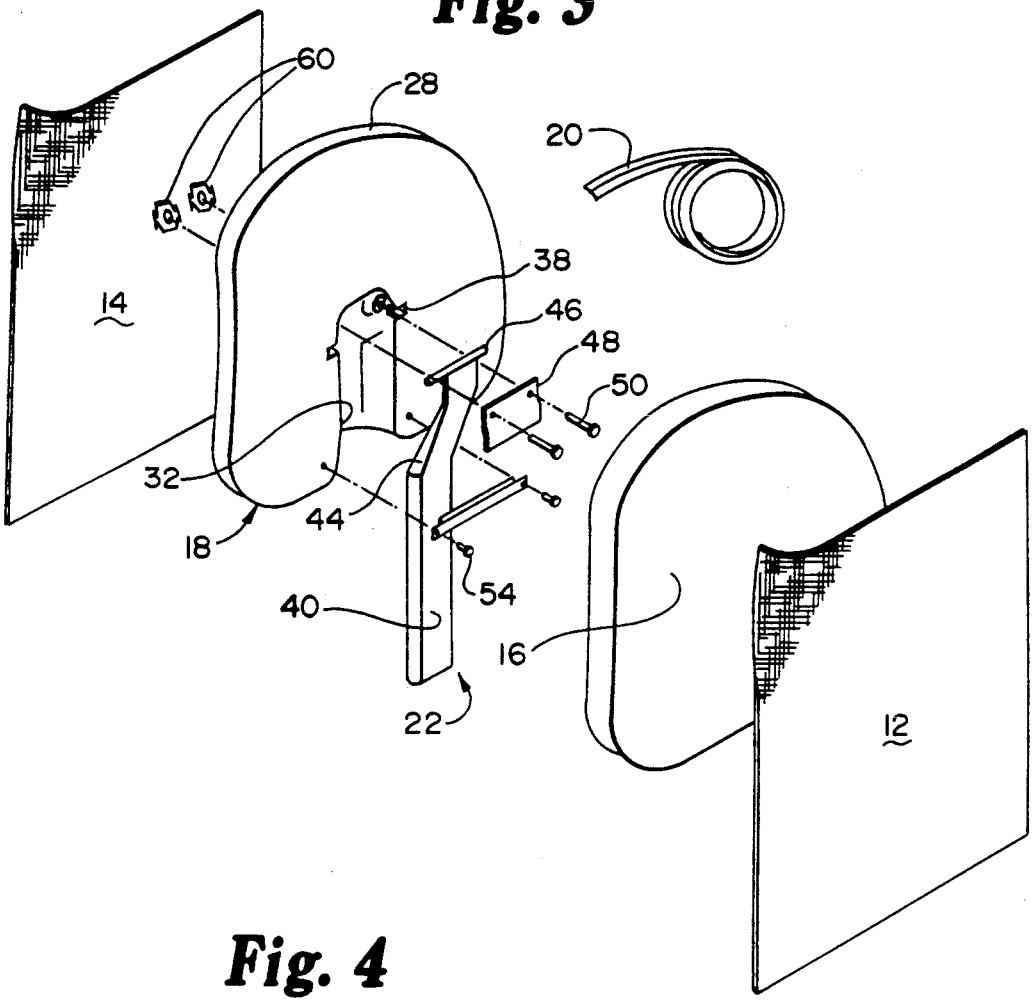
FIG. 3 is a perspective view a construction of the present invention shown in FIG. 1.
Figure 4:
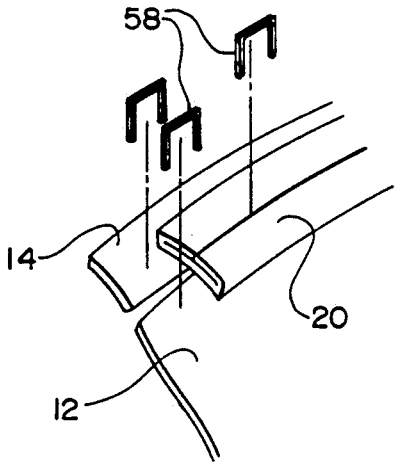
FIG. 4 shows the details of attachment of front and back coverings to a backing number of the present invention.

FIG. 3 is an exploded view of all of the components of the invention shown in FIG. 1. Of particular interest is the depiction of front and rear cloths 12, 14 and, especially in FIG. 4, their mode of attachment to backing member 18 by means of cloth trim 20. Cloth trim 20 is attached to backing member 18 by means a plurality of lines of staples 58. It is believed to be a unique feature of this invention, that utilization of a backing member of the preferred thickness permits a plurality of lines of staples to be used to attached to the front and rear clothes to the edge (e.g., top edge 28) of backing member 18. This unique feature of the invention permits chair backs to be produced with the present backing member with fewer manufacturing steps.

Figure 5:
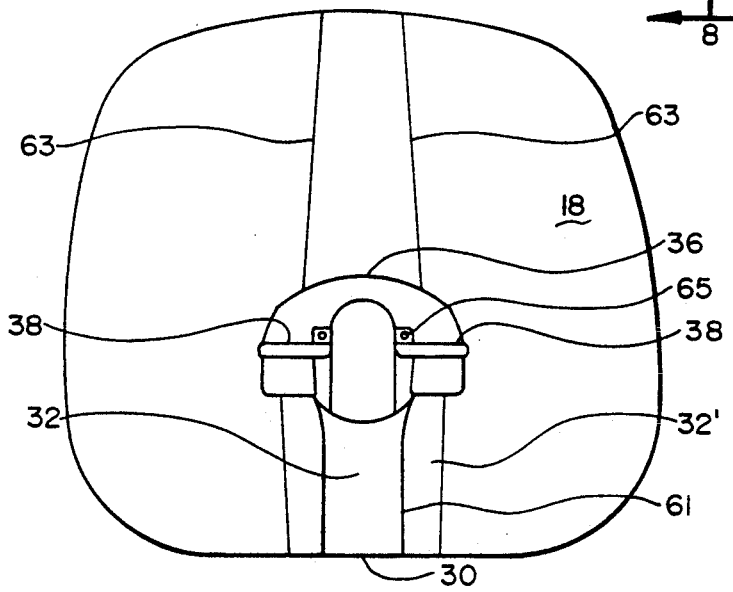
FIG. 5 is a front view of a backing member of this invention.

FIG. 5 is a front view of a backing member of this invention. Of particular importance is the fact that channel 32 has two depths 32, 32', the two depths being separated by countour line 61. Countour line 63 delimits an optional forwardly projecting upper portion of the backing member. Holes 65 are drilled or formed entirely through backing member 18.

Figure 6:
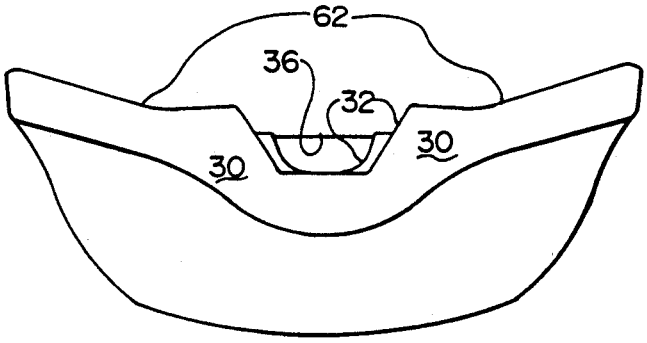
FIG. 6 is view of a backing member of the present invention from its edge.

FIG. 6 shows a view of a backing member 18 of the present invention from bottom edge 30. This is a view up channel 32 which shows that, in a preferred configuration, channel 32 is reduced in width and depth to accommodate vertical support member 22 near its terminus. Channel 32 may have a uniform or essentially any cross sectional configuration which closely accommodates vertical support 22. If a straight "T"-shaped vertical support member is employed, channel 32 would be of uniform, e.g., rectangular, width and depth.

Figure 7:
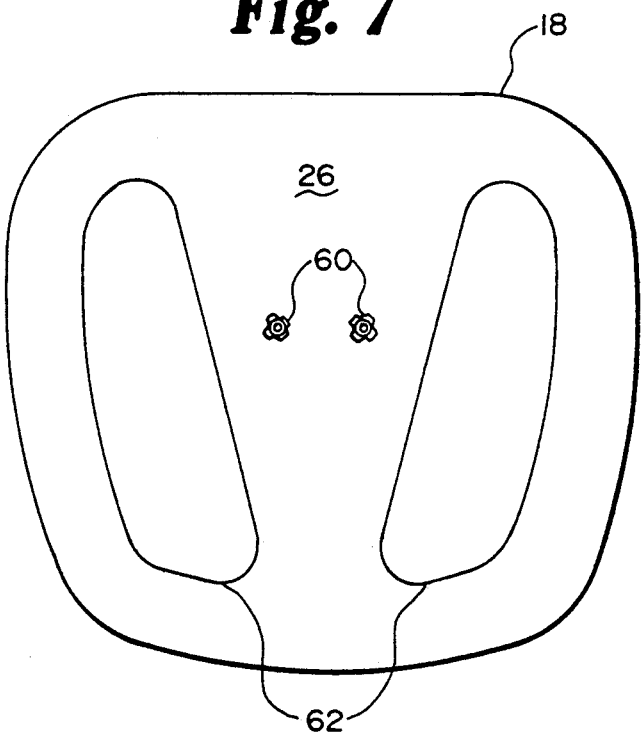
FIG. 7 is a view of a backing member of the present invention from its back side.

FIG. 7 shows back side 26 of backing member 18. Of particular interest is the fact that nuts 60 are used to anchor screws 50 through backing member 18 to provide enhanced strength of attachment of vertical support member 22 to the opposite side of backing member 18. Optional contours 62 are molded into the back face 24 of the backing member to provide sufficient relief for channel 32 to be formed in the front side of backing member 18 while maintaining sufficient backing thickness.

Figure 8:
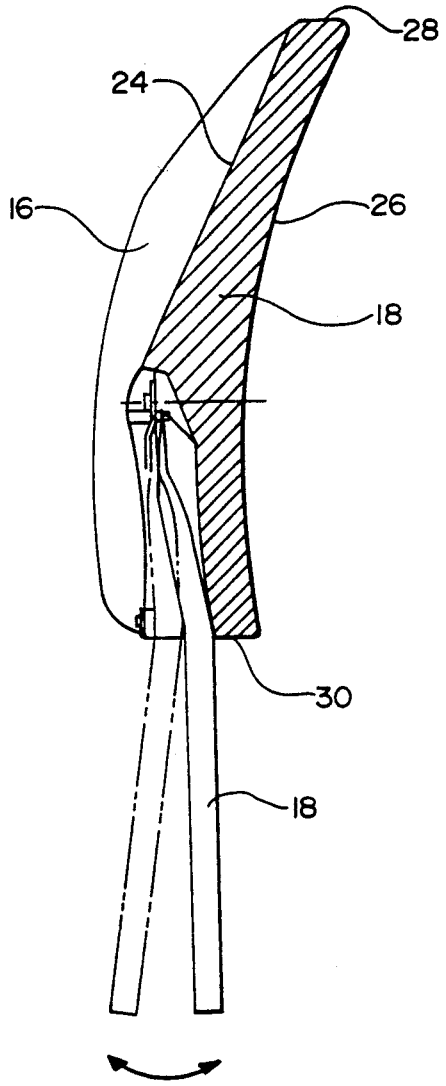
FIG. 8 a cross sectional view of a backing member of the present invention taken along line 8—8 of FIG. 1 showing the pivoting latitude.

FIG. 8 shows in section the pivot motion which is permitted in a practice of this invention. Vertical support member 22 supports chair back 10, and, by virtue of the unique structural arrangement of this invention, permits front-to-back pivoting without substantial incidence of "half-moon" failure.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is as follows:

1. A one-piece back support for a chair, the support comprising:

a substantially integral backing member, the backing member having a front side, a back side, top and bottom edges, the backing member defining on its front side, a substantially vertical, concave channel, said channel communicating with the bottom edge of the backing member and terminating interiorly of said backing member at substantially the center of the backing member, the channel being shaped to receive a "T"-shaped vertical support member such that said backing member is supported by said support member and can be pivoted, back-to-front, thereabout, said channel including laterally directed notches, said notches projecting from said channel at its terminus so as to receive a "T" portion of the vertical support member; and means for limiting the extent to which the backing member can be pivoted with respect to the vertical support member when said backing member is supported by said vertical support member, said limiting means being disposed over at least a portion of the channel proximate the bottom edge of the backing member.

2. A back support according to claim 1 which further includes:

means to retain the "T" portion of the vertical support member in the notches.

3. A back support according to claim 1 wherein said backing member comprises compression molded particle board, said backing member being at least ¾ inches thick from its front side to its back side.

4. A one-piece back support for a chair, the support comprising:

a substantially integral backing member, the backing member having a front side, a back side, top and bottom edges, the backing member defining on its front side, a substantially vertical, concave channel, said channel communicating with the bottom edge of the backing member and terminating interiorly of said backing member to substantially the center of the backing member, the channel being shaped to receive a "T"-shaped vertical support member such that said backing member is supported by said vertical support member and can be pivoted, back-to-front, thereabout, said channel including:

horizontally directed notches, said notches projecting from said channel adjacent its terminus so as to receive a "T" portion of the vertical support member, the backing member further including:

means for retaining the "T" portion of the vertical support member in the horizontally directed notches, and means for limiting the extent to which the backing member can be pivoted with respect to the vertical support member when said backing member is supported thereby, said limiting means being disposed over at least a portion of the channel proximate the bottom edge of the backing member.

5. A back support according to claim 4 wherein the retaining means comprises a rectangular plate, said plate being fixed to the front side of the backing member to retain said "T" portion of the vertical support member within said horizontally directed notches.

6. A back support according to claim 4 wherein said limiting means comprises a flat bracket.

7. A back support according to claim 4 wherein the limiting means comprises a flat plate having a staple ledge interiorly attached thereto.

8. A back support according to claim 4 wherein said "T" shaped vertical support member is angularly offset toward the front side of said backing member, and said "T" portion of said vertical support member is held within said notches by said retaining means so that said backing member can pivot with respect to said vertical support member and wherein said limiting means limits the extent to which said backing member can pivot with respect to said vertical support member.

9. A back support according to claim 4 wherein said backing member further includes a pad disposed on its front side.

* * * * *